US008290183B2

(12) United States Patent
Jiang et al.

(10) Patent No.: US 8,290,183 B2
(45) Date of Patent: Oct. 16, 2012

(54) ILLUMINATING DEVICE

(75) Inventors: Kai-Li Jiang, Beijing (CN); Chen Feng, Beijing (CN); Lin Xiao, Beijing (CN); Zhuo Chen, Beijing (CN); Liang Liu, Beijing (CN); Shou-Shan Fan, Beijing (CN); Qun-Qing Li, Beijing (CN); Li Qian, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 616 days.

(21) Appl. No.: 12/584,419

(22) Filed: Sep. 3, 2009

(65) Prior Publication Data

US 2010/0085729 A1 Apr. 8, 2010

(30) Foreign Application Priority Data

Oct. 8, 2008 (CN) ..... 2008 1 0216493

(51) Int. Cl.
*H04R 25/00* (2006.01)
*H04R 7/00* (2006.01)

(52) U.S. Cl. ..... 381/164; 381/426

(58) Field of Classification Search ..... 381/164
See application file for complete search history.

(56) References Cited

U.S. PATENT DOCUMENTS

| | | | | |
|---|---|---|---|---|
| 2,501,968 | A * | 3/1950 | Sassin | 455/345 |
| 4,875,143 | A * | 10/1989 | Fernandez | 362/86 |
| 2007/0171671 | A1 | 7/2007 | Kurokawa et al. | |
| 2008/0170982 | A1 * | 7/2008 | Zhang et al. | 423/447.3 |
| 2009/0145686 | A1 | 6/2009 | Watabe et al. | |

FOREIGN PATENT DOCUMENTS

| | | | |
|---|---|---|---|
| JP | 59-113910 | | 8/1984 |
| JP | 2002-186097 | | 6/2002 |
| JP | 2004-23509 | | 1/2004 |
| JP | 2004015261 | A * | 1/2004 |
| JP | 2006-140858 | | 6/2006 |
| JP | 2008-523254 | | 7/2008 |
| JP | 2009-296592 | | 12/2009 |
| WO | WO2005083475 | | 9/2005 |
| WO | WO2007049496 | | 5/2007 |

* cited by examiner

*Primary Examiner* — Brian Ensey
(74) *Attorney, Agent, or Firm* — Altis Law Group, Inc.

(57) ABSTRACT

An illuminating device includes a holding element, a light source, and an acoustic member. The acoustic member includes a carbon nanotube structure.

20 Claims, 13 Drawing Sheets

ILLUMINATING DEVICE

BACKGROUND

1. Technical Field

The present disclosure relates to illuminating devices, particularly, to an acoustic illuminating device.

2. Description of Related Art

An illuminating device generally includes a light source, a holding structure to hold the light source, and a lampshade to cover the light source. However, in many applications, people may need or want the illuminating device to emit sound as well as light. To solve this problem, an additional acoustic member can be mounted on the holding structure.

There are different types of acoustic members that can be categorized according by their working principles, such as electro-dynamic acoustic members, electromagnetic acoustic members, electrostatic acoustic members and piezoelectric acoustic members. The various types ultimately use mechanical vibration to produce sound waves, in other words they all achieve "electro-mechanical-acoustic" conversion. Among the various types, the electro-dynamic acoustic members are most widely used. For example, an electro-dynamic acoustic member, according to the prior art, typically includes a voice coil, a magnet and a cone. The voice coil is an electrical conductor, and is placed in the magnetic field of the magnet. By applying an electrical current to the voice coil, a mechanical vibration of the cone is produced due to the interaction between the electromagnetic field produced by the voice coil and the magnetic field of the magnets, thus producing sound waves by kinetically pushing the air. The cone will reproduce the sound pressure waves, corresponding to the original input signal.

However, the structure of the electro-dynamic acoustic member is dependent on magnetic fields and often weighty magnets. The structure of the electric-dynamic acoustic member is complicated and enlarges the size of the illuminating device. The magnet of the electric-dynamic acoustic member may interfere or even destroy other electrical devices near the acoustic member.

Further, in other situations, people may need the illuminating device to emit heat as well as light. To solve this problem, a high-power bulb can be used as the light source in the illuminating device, and thus the choice of the light source is limited.

What is needed, therefore, is to provide an effective illuminating device having a simple lightweight structure that is able to produce sound and heat, as well as light.

BRIEF DESCRIPTION OF THE DRAWINGS

Many aspects of the present illuminating device can be better understood with reference to the following drawings. The components in the drawings are not necessarily to scale, the emphasis instead being placed upon clearly illustrating the principles of the present illuminating device.

DETAILED DESCRIPTION OF EXEMPLARY EMBODIMENTS

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
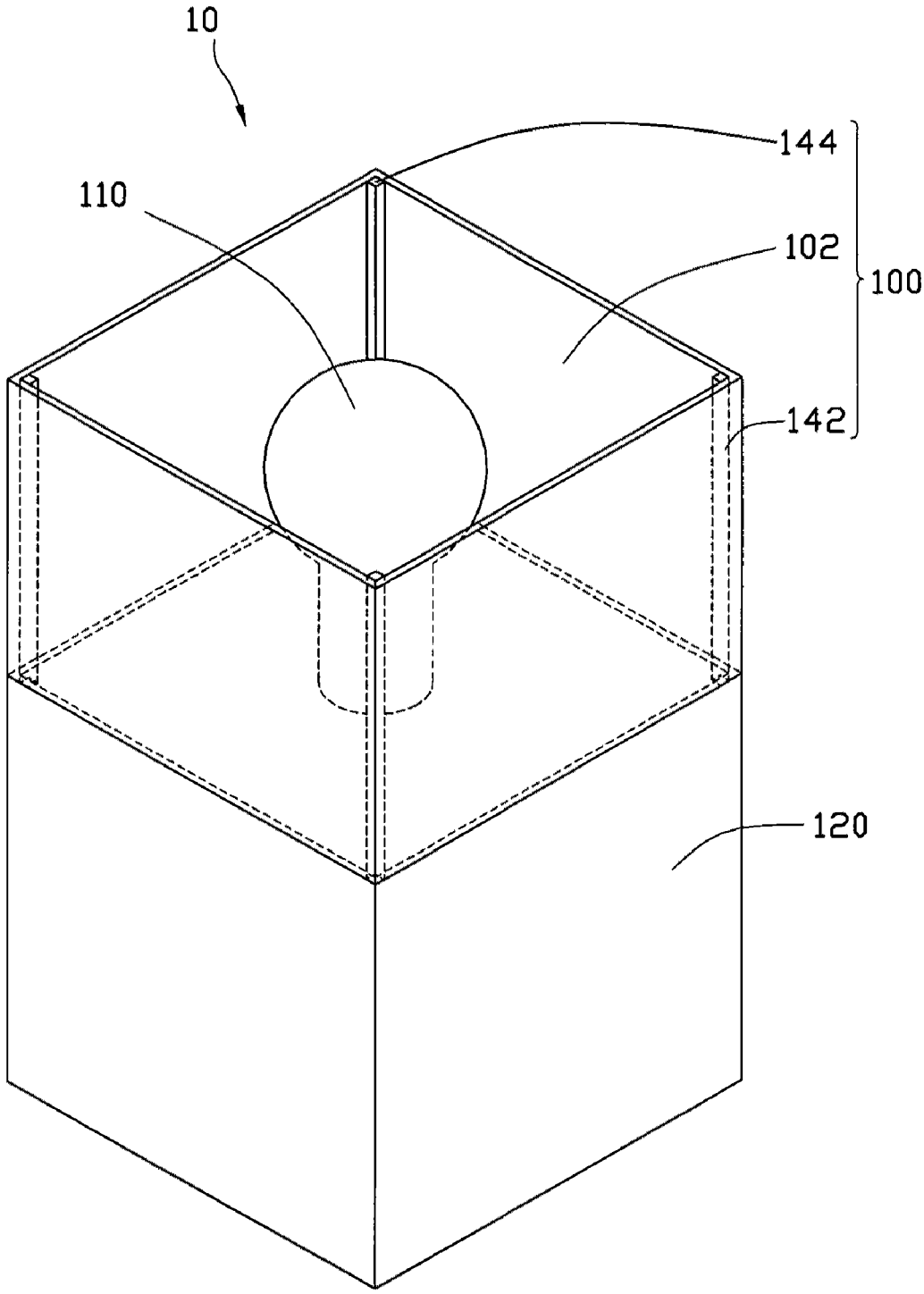
FIG. 1 is a schematic structural view of an illuminating device in accordance with a first embodiment.

Referring to FIG. 1, an illuminating device 10 according to a first embodiment includes a light source 110, an acoustic member 100, and a holding element 120. The light source 110 is mounted on the holding element 120. The acoustic member 100 is held by the holding element 120 and adjacent to the light source 110. The acoustic member 100 and the light source 110 are integratedly fixed to the holding element 120.

The light source 110 can be a spot light source such as a bulb, a linear light source, or a planar light source. The light source 110 can be a fluorescent lamp, a gas discharge lamp, an electric arc lamp, a light-emitting diode lamp, an electric-emitting lamp, or any other light emitting source.

The structure and material of the holding element 120 is not limited. The holding element 120 should have a suitable toughness and strength to support the light source 110 and the acoustic member 100. The holding element 120 can be insulated from both the light source 110 and the acoustic member 100. In the embodiment shown in FIG. 1, the holding element 120 is a base. The base can define a hollow space therein. Conducting wires (not shown) connected to the light source 110 and acoustic member 100 can be housed in the hollow space of the base.

Figure 2:
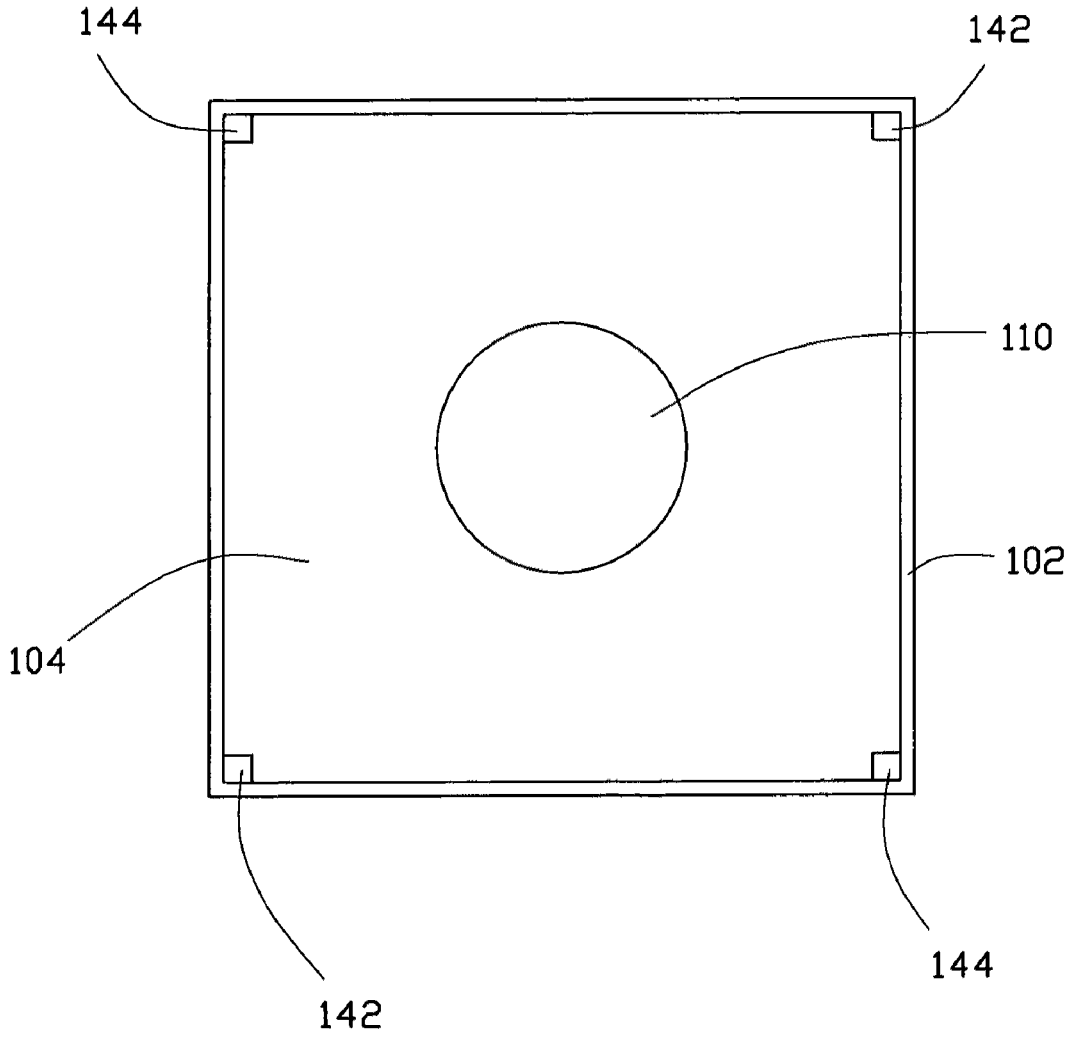
FIG. 2 is a schematic top view of the illuminating device of FIG. 1.

The acoustic member 100 can be spaced apart from the light source 110. The acoustic member 100 can be plane-shaped, curved surface-shaped, or a three dimensional structure with a hollow space therein. In one embodiment, the acoustic member 100 has a curved surface and can at least partially surround the light source 110. In other embodiments, the acoustic member 100 has a three dimensional structure with a hollow space therein, and at least partially encloses the light source 110. In other embodiments, the acoustic member 100 is planar, and can be disposed at one side of the light source 110 and faces the light source 110. When the acoustic member 100 encloses or partially encloses the light source 110, the acoustic member 100 can be used as a lampshade. Referring to FIGS. 1 and 2, the acoustic member 100 can be disposed in a hollow column structure with an opening 104, and the light source 110 can be disposed at the center of the hollow column structure.

The acoustic member 100 includes a sound wave generator 102, at least one first electrode 142, and at least one second electrode 144. The first and second electrodes 142, 144 are located apart from each other, and are electrically connected to the sound wave generator 102. The first electrode 142 and the second electrode 144 input electric signals from a signal device (not shown) to the sound wave generator 102. The sound wave generator 102 comprises of a carbon nanotube film.

The first electrode 142 and the second electrode 144 are made of conductive material. The shape of the first electrode 142 or the second electrode 144 is not limited and can be lamellar, rod, wire, and block among other shapes. The material of the first electrode 142 or the second electrode 144 can be metals, conductive adhesives, carbon nanotubes, and indium tin oxides among other materials. The sound wave generator 102 is electrically connected to the first electrode 142 and the second electrode 144. The first electrode 142 and the second electrode 144 can be electrically connected to a signal device by a conductive wire (not shown) for inputting electric signals to the sound wave generator 102. More specifically, the sound wave generator 102 is a resistive element which is series connected to the signal device by the first electrode 142 and the second electrode 144.

In one embodiment, the first electrode 142 and the second electrode 144 are rigid rods. The electrodes 142, 144 can provide structural support for the sound wave generator 102, thus the sound wave generator 102 between the adjacent first electrode 142 and second electrode 144 are suspended in a medium (such as air). The first and second electrode 142, 144 are mounted on the holding element 120.

In the embodiment as shown in FIGS. 1 and 2, the acoustic member 100 includes two first electrodes 142 and two second electrodes 144. The first and second electrodes 142, 144 are metal rods, and are all vertically disposed on a top surface of the holding element 120. The sound wave generator 102 supported by the first electrodes 142 and the second electrodes 144 forms a hollow structure and surrounds the light source 110. The light source 10 is disposed in the hollow space of the sound wave generator 102. More specifically, the holding element 120 can be a cube-shaped base. The two first electrodes 142 are disposed on two diagonal corners of a top surface of the cubic base. The two second electrodes 144 are disposed on the other two diagonal corners of the top surface of the cubic base. The light source 110 is disposed at the center of the top surface of the cubic base. The lights emitted from the light source 110 can transmit through the sound wave generator 102.

It is to be understood that the number of the electrodes are not limited. The first electrodes 142 and second electrodes 144 are alternately connected to the sound wave generator 102, and divide the sound wave generator 102 into many parts between each of the adjacent first and second electrodes 142, 144. All the first electrodes 142 are electrically connected to one terminal of the signal device, all the second electrodes 144 are electrically connected to the other terminal of the signal device, and thus all parts of the sound wave generator 102 between each of the adjacent first and second electrode 142, 144 are connected in parallel.

The sound wave generator 102 includes a carbon nanotube structure. The carbon nanotube structure can have many different structures such as a film shape or a wire shape. The carbon nanotube structure has a large specific surface area (e.g., above 50 $m^2/g$) that contacts to surrounding medium (such as air). The heat capacity per unit area of the carbon nanotube structure can be less than $2\times10^{-4}$ $J/cm^2\cdot K$. In one embodiment, the heat capacity per unit area of the carbon nanotube structure is less than or equal to about $1.7\times10^{-6}$ $J/cm^2\cdot K$. The carbon nanotube structure can include a plurality of carbon nanotubes uniformly distributed therein, and the carbon nanotubes therein can be combined by van der Waals attractive force therebetween.

The carbon nanotube structure can be a substantially pure structure consisting mostly of carbon nanotubes. In another embodiment, the carbon nanotube structure can also include other components. For example, metal layers can be deposited on surfaces of the carbon nanotubes. However, whatever the detailed structure of the carbon nanotube structure, the heat capacity per unit area of the carbon nanotube structure should be relatively low, such as less than $2\times10^{-4}$ $J/m^2\cdot K$, and the specific surface area of the carbon nanotube structure that contacts to the surrounding medium for a thermal exchange should be relatively high.

It is understood that the carbon nanotube structure must include metallic carbon nanotubes. The carbon nanotubes in the carbon nanotube structure can be arranged orderly or disorderly.

The term 'disordered carbon nanotube structure' includes a structure where the carbon nanotubes are arranged along many different directions, arranged such that the number of carbon nanotubes arranged along each different direction can be almost the same (e.g. uniformly disordered); and/or entangled with each other. The disordered carbon nanotube structure can be isotropic.

'Ordered carbon nanotube structure' includes a structure where the carbon nanotubes are arranged in a consistently systematic manner, e.g., the carbon nanotubes are arranged approximately along a same direction and or have two or more sections within each of which the carbon nanotubes are arranged approximately along a same direction (different sections can have different directions).

The carbon nanotubes in the carbon nanotube structure can be selected from single-walled, double-walled, and/or multi-walled carbon nanotubes. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The carbon nanotube structure can also be a wire with a diameter of about 0.5 nanometers to about 1 millimeter. The greater the specific surface area of the carbon nanotube structure, the smaller the heat capacity per unit area will be. The smaller the heat capacity per unit area, the larger the sound pressure level of the acoustic member 100.

Figure 3:
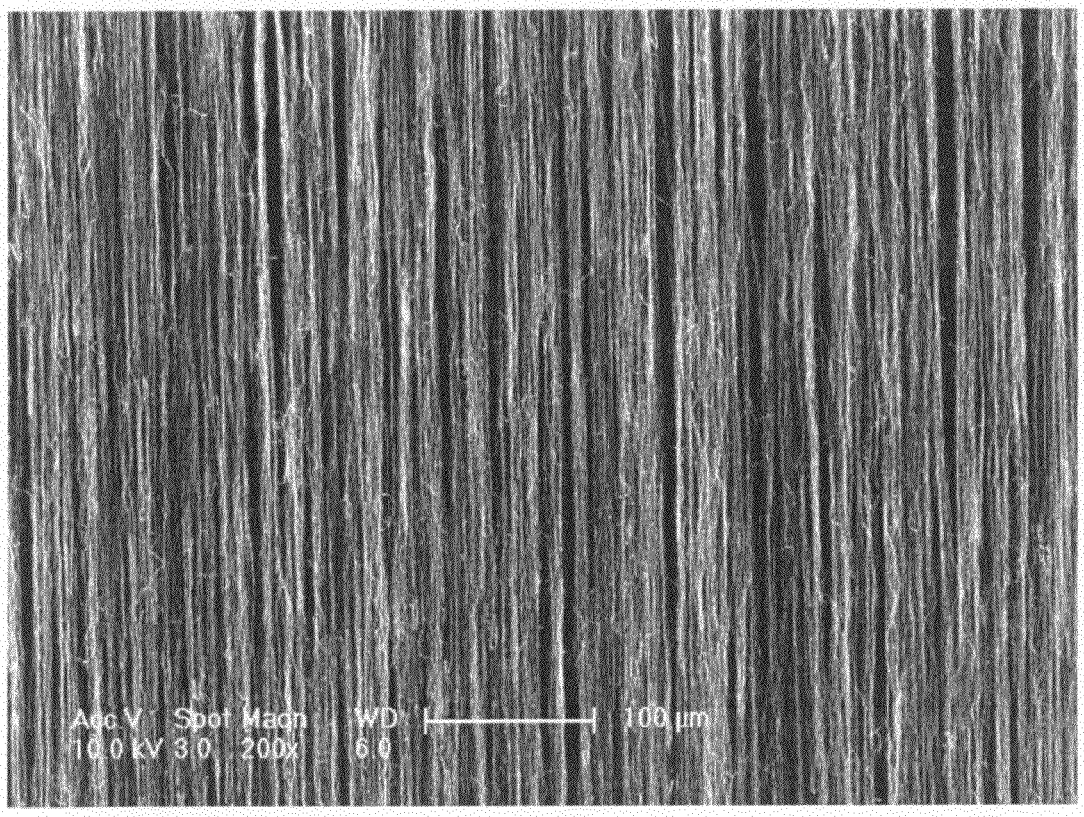
FIG. 3 shows a Scanning Electron Microscope (SEM) image of a carbon nanotube film.
Figure 4:
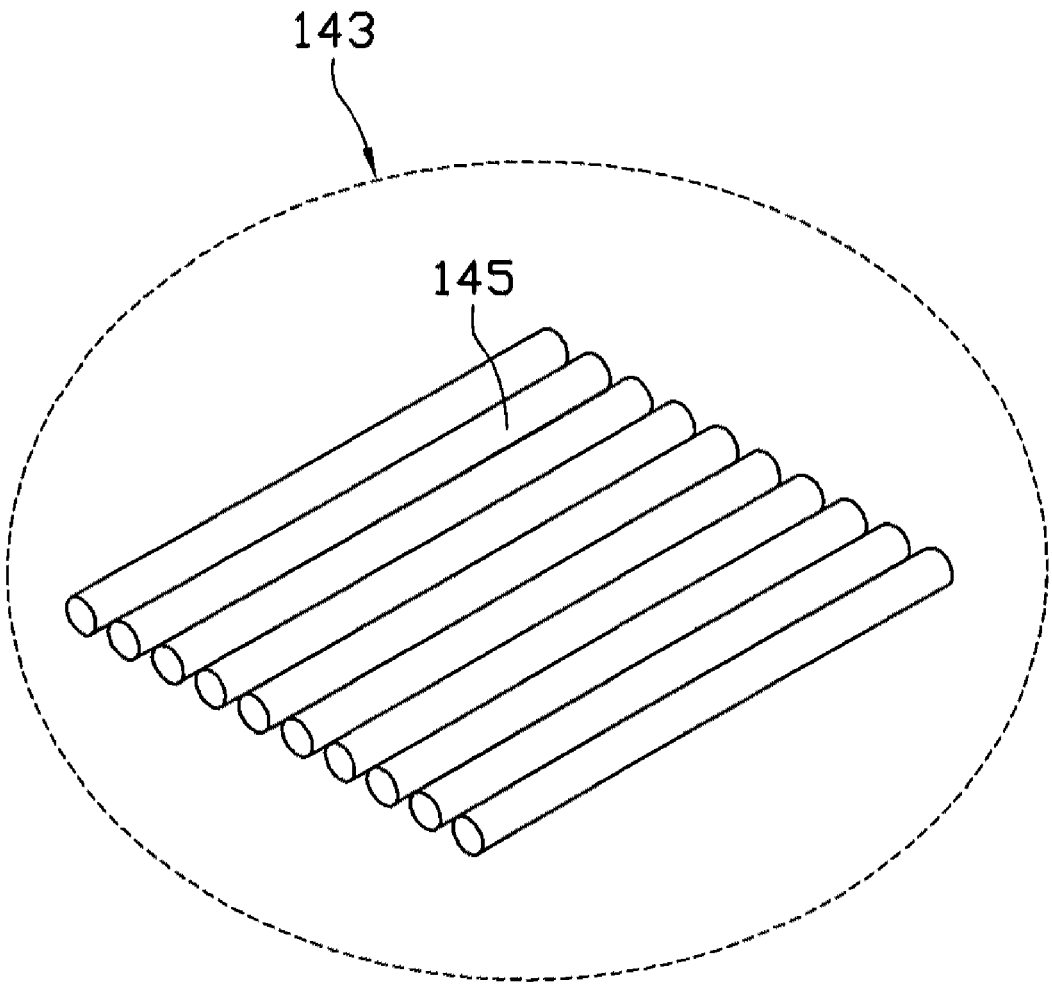
FIG. 4 is a schematic structural view of a carbon nanotube segment in the carbon nanotube film of FIG. 3.

In one embodiment, the carbon nanotube structure can include at least one drawn carbon nanotube film. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be a free-standing film. The drawn carbon nanotube film can be formed by drawing a film from a carbon nanotube array that is capable of having a film drawn therefrom. Referring to FIGS. 3 to 4, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 3, some variations can occur in the drawn carbon nanotube film. This is true of all carbon nanotube films. The carbon nanotubes 145 in the drawn carbon nanotube film are also oriented along a preferred orientation. The carbon nanotube film also can be treated with an organic solvent. After that, the mechanical strength and toughness of the treated carbon nanotube film are increased and the coefficient of friction of the treated carbon nanotube films is reduced. The treated carbon nanotube film has a larger heat capacity per unit area and thus produces less of a thermoacoustic effect than the same film before treatment. A thickness of the carbon nanotube film can range from about 0.5 nanometers to about 100 micrometers. The thickness of the drawn carbon nanotube film can be very thin and thus, the heat capacity per unit area will also be very low. The single drawn carbon nanotube film has a specific surface area of above about 100 $m^2/g$.

The carbon nanotube structure of the sound wave generator 102 can also include at least two stacked carbon nanotube films. In other embodiments, the carbon nanotube structure can include two or more coplanar carbon nanotube films. These coplanar carbon nanotube films can also be stacked one upon other films. Additionally, an angle can exist between the orientation of carbon nanotubes in adjacent films, stacked and/or coplanar. Adjacent carbon nanotube films can be combined only by the van der Waals attractive force therebetween. The number of the layers of the carbon nanotube films is not limited. However, as the stacked number of the carbon nanotube films increasing, the specific surface area of the carbon nanotube structure will decrease, and a large enough specific surface area (e.g., above 50 $m^2/g$) must be maintained to achieve the thermoacoustic effect. An angle between the aligned directions of the carbon nanotubes in the two adjacent carbon nanotube films can range from 0 degrees to about 90 degrees. Spaces are defined between two adjacent and side-by-side carbon nanotubes in the drawn carbon nanotube film. When the angle between the aligned directions of the carbon nanotubes in adjacent carbon nanotube films is larger than 0 degrees, a microporous structure is defined by the carbon nanotubes in the sound wave generator 102. The carbon nanotube structure in an embodiment employing these films will have a plurality of micropores. Stacking the carbon nanotube films will add to the structural integrity of the carbon nanotube structure. In some embodiments, the carbon nanotube structure has a free standing structure and does not require the use of structural support.

Furthermore, the carbon nanotube film and/or the entire carbon nanotube structure can be treated, such as by laser, to improve the light transmittance of the carbon nanotube film or the carbon nanotube structure. For example, the light transmittance of the untreated drawn carbon nanotube film ranges from about 70%-80%, and after laser treatment, the light transmittance of the untreated drawn carbon nanotube film can be improved to about 95%. The heat capacity per unit area and specific surface area of the carbon nanotube film and/or the carbon nanotube structure will increase after the laser treatment.

In other embodiments, the carbon nanotube structure includes a plurality of carbon nanotube wire structures. The carbon nanotube wire structure includes at least one carbon nanotube wire. A heat capacity per unit area of the carbon nanotube wire structure can be less than $2\times10^{-4}$ $J/cm^2\cdot K$. In one embodiment, the heat capacity per unit area of the carbon nanotube wire-like structure is less than $5\times10^{-5}$ $J/cm^2\cdot K$. The carbon nanotube wire can be twisted or untwisted. The carbon nanotube wire structure includes carbon nanotube cables that comprise of twisted carbon nanotube wires, untwisted carbon nanotube wires, or combinations thereof. The carbon nanotube cable comprises of two or more carbon nanotube wires, twisted or untwisted, that are twisted or bundled together. The carbon nanotube wires in the carbon nanotube wire structure can be parallel to each other to form a bundle-like structure or twisted with each other to form a twisted structure.

Figure 5:
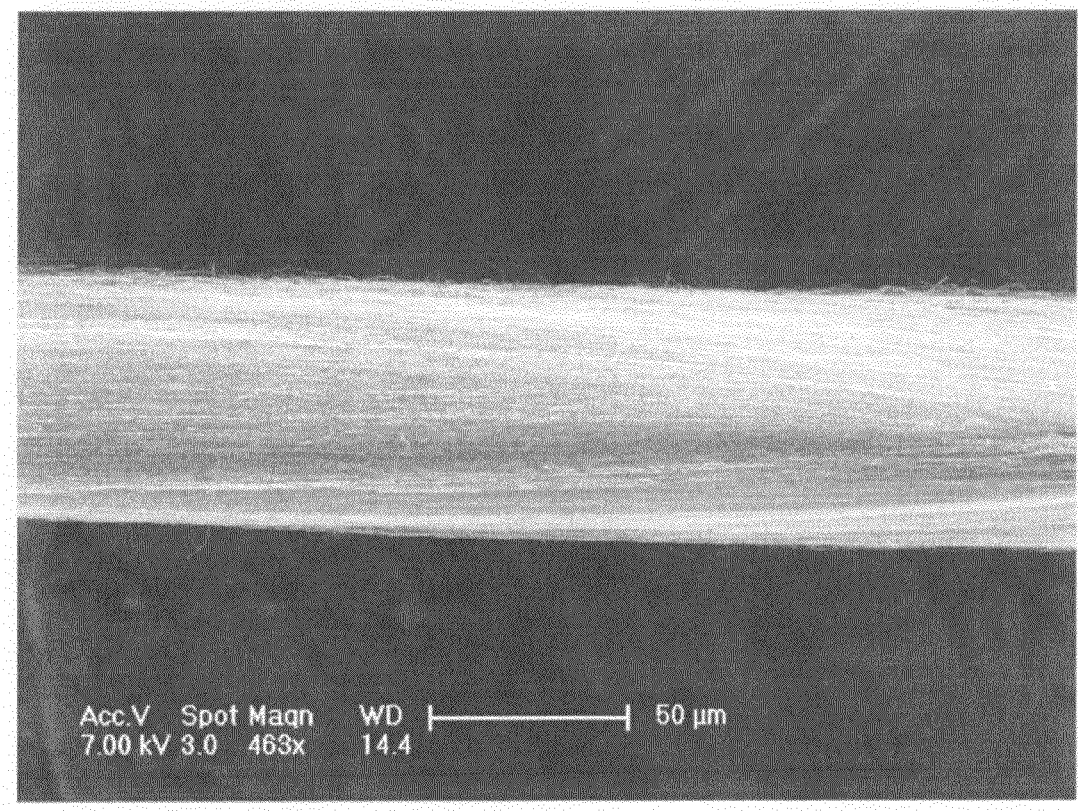
FIG. 5 shows an SEM image of an untwisted carbon nanotube wire.

The untwisted carbon nanotube wire can be formed by treating the drawn carbon nanotube film with an organic solvent. Specifically, the drawn carbon nanotube film is treated by applying the organic solvent to the drawn carbon nanotube film to soak the entire surface of the drawn carbon nanotube film. After being soaked by the organic solvent, the adjacent paralleled carbon nanotubes in the drawn carbon nanotube film will bundle together, due to the surface tension of the organic solvent when the organic solvent volatilizing, and thus, the drawn carbon nanotube film will be shrunk into untwisted carbon nanotube wire. Referring to FIG. 5, the untwisted carbon nanotube wire includes a plurality of carbon nanotubes substantially oriented along a same direction (e.g., a direction along the length of the untwisted carbon nanotube wire). The carbon nanotubes are substantially parallel to the axis of the untwisted carbon nanotube wire. Length of the untwisted carbon nanotube wire can be set as desired. The diameter of an untwisted carbon nanotube wire can range from about 0.5 nanometers to about 100 micrometers. In one embodiment, the diameter of the untwisted carbon nanotube wire is about 50 micrometers. Examples of the untwisted carbon nanotube wire are taught by US Patent Application Publication US 2007/0166223 to Jiang et al.

Figure 6:
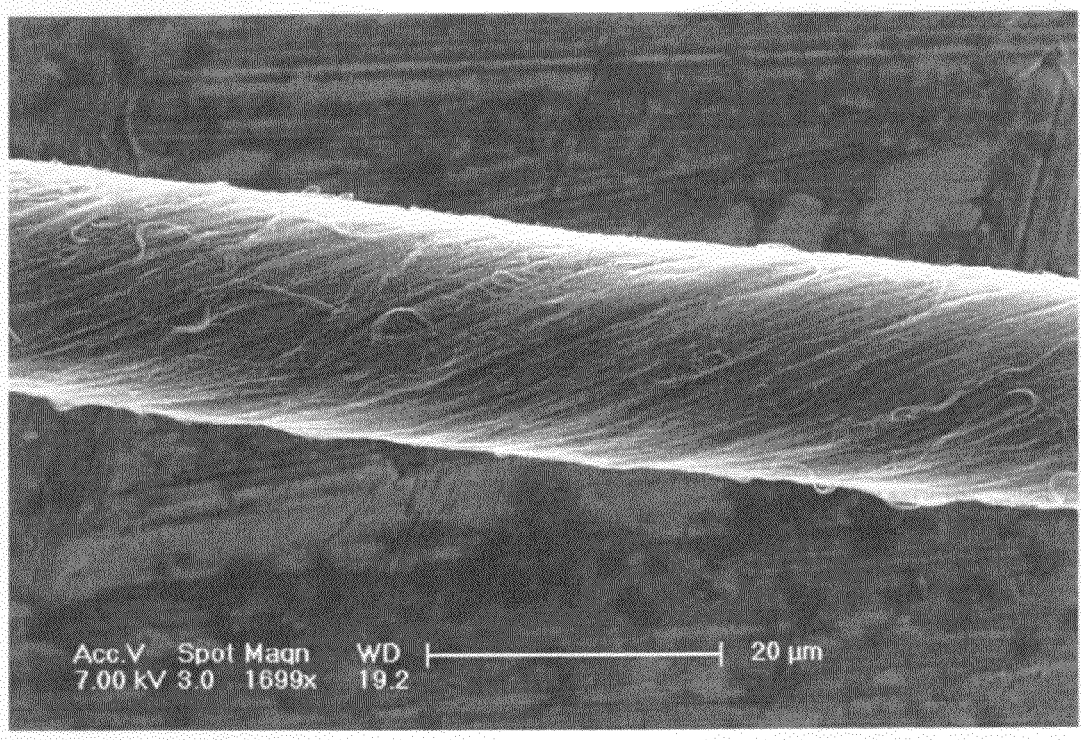
FIG. 6 shows an SEM image of a twisted carbon nanotube wire.

The twisted carbon nanotube wire can be formed by twisting a drawn carbon nanotube film by using a mechanical force to turn the two ends of the drawn carbon nanotube film in opposite directions. Referring to FIG. 6, the twisted carbon nanotube wire includes a plurality of carbon nanotubes oriented around an axial direction of the twisted carbon nanotube wire. The carbon nanotubes are aligned around the axis of the carbon nanotube twisted wire like a helix. Length of the carbon nanotube wire can be set as desired. The diameter of the twisted carbon nanotube wire can range from about 0.5 nanometers to about 100 micrometers. Further, the twisted carbon nanotube wire can be treated with a volatile organic solvent, before or after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease. The density and strength of the twisted carbon nanotube wire will be increased. It is understood that the twisted and untwisted carbon nanotube cables can be produced by methods that are similar to the methods of making twisted and untwisted carbon nanotube wires.

Figure 7:
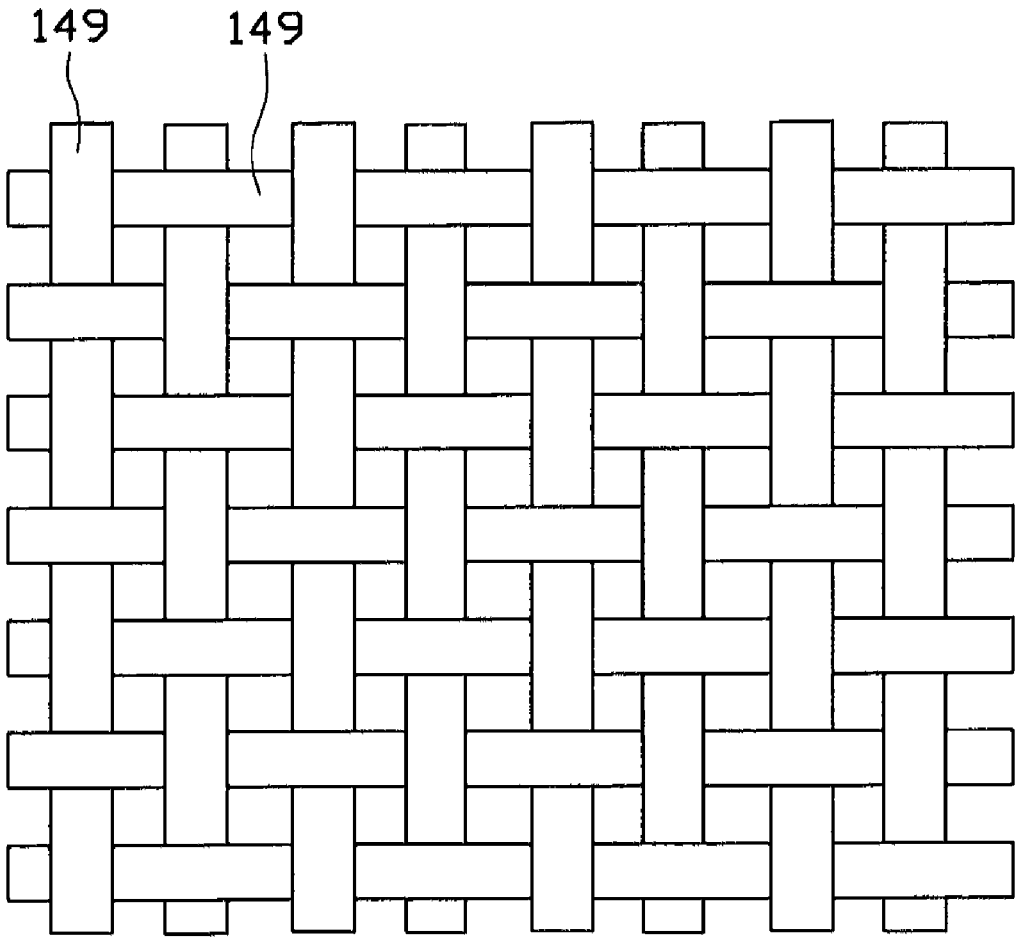
FIG. 7 shows a schematic view of a textile formed by a plurality of carbon nanotube wires and/or films.

The carbon nanotube structure can include a plurality of carbon nanotube wire structures. The plurality of carbon nanotube wire structures can be paralleled with each other, cross with each other, weaved together, or twisted with each other. The resulting structure can be a planar structure if so desired. Referring to FIG. 7, a carbon nanotube textile can be formed by the carbon nanotube wire structures 149 and used as the carbon nanotube structure. It is also understood that the carbon nanotube textile can also be formed by treated and/or untreated carbon nanotube films.

The sound wave generator 102 is also able to produce sound waves even when a part of the carbon nanotube structure is punctured and/or torn. Also during the stretching process, if part of the carbon nanotube structure is punctured and/or torn, the carbon nanotube structure is still able to produce sound waves. This will be impossible for a vibrating film or a cone of a conventional acoustic member.

In the embodiment shown in FIG. 1, the sound wave generator 102 includes a carbon nanotube structure comprising the drawn carbon nanotube film. The width of the drawn carbon nanotube film is equal to or smaller than the length of the first and second electrodes 142, 144, thus all the carbon nanotubes in the drawn carbon nanotube film can be conducted by the input electrical signals. The drawn carbon nanotube film surrounds and is further supported by the first and second electrodes 142, 144. The carbon nanotubes in the sound wave generator 102 are aligned along a direction from the first electrode 142 to the second electrode 144.

The carbon nanotube structure comprises a plurality of carbon nanotubes and has a small heat capacity per unit area. The carbon nanotube structure can have a large area for causing the pressure oscillation in the surrounding medium by the temperature waves generated by the sound wave generator 102. In use, when electrical signals, with variations in the application of the signal and/or strength are input applied to the carbon nanotube structure of the sound wave generator 102, heat is produced in the carbon nanotube structure according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the sound wave generator 102 that produces sound. This is distinct from the mechanism of the conventional acoustic member, in which the pressure waves are created by the mechanical movement of the diaphragm. The input signals are electrical signals, and the operating principle of the acoustic member 100 is an "electrical-thermal-sound" conversion. This heat causes detectable sound signals due to pressure variation in the surrounding (environmental) medium.

Figure 8:
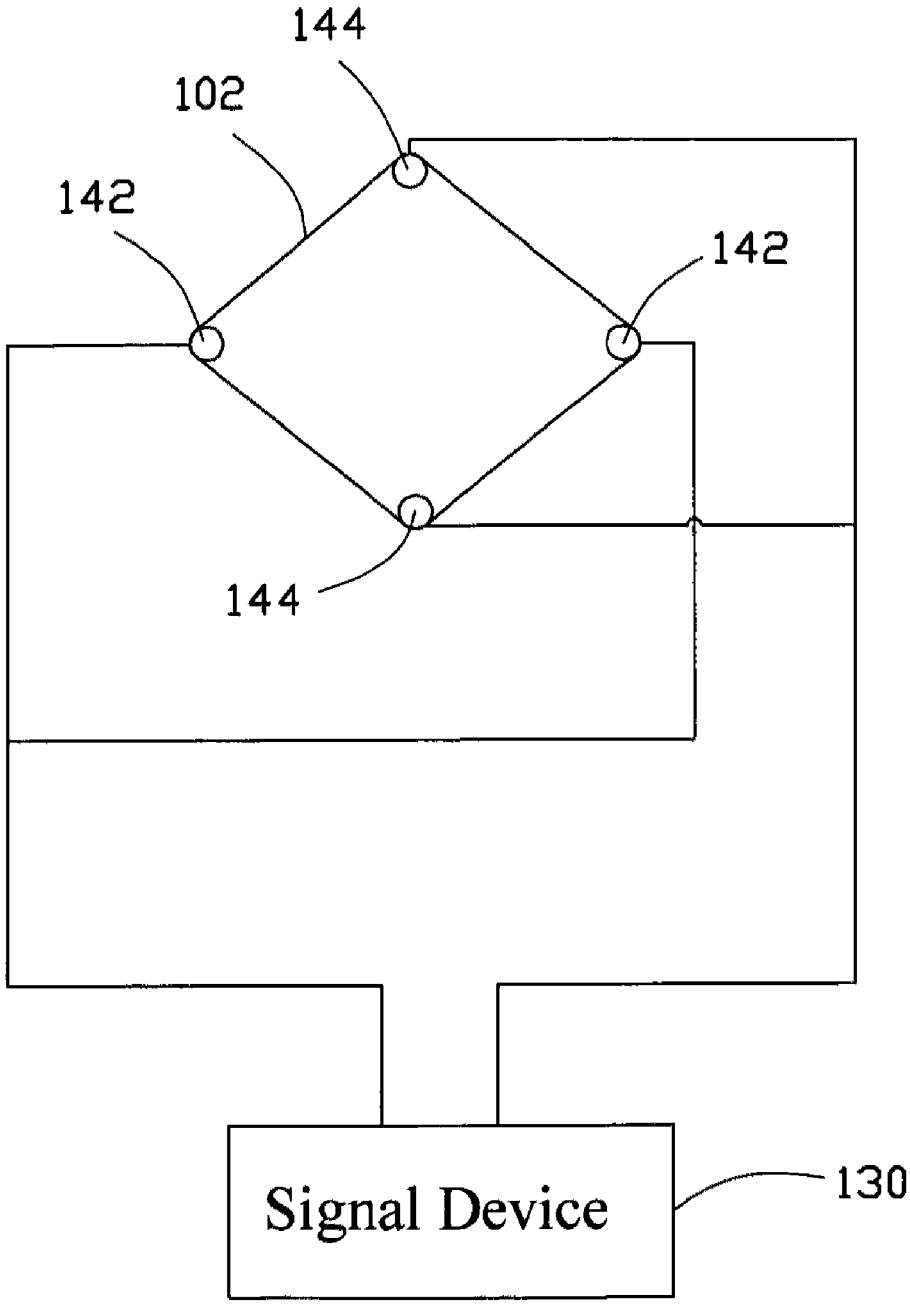
FIG. 8 is a circuit of an acoustic member in the illuminating device of FIG. 1.

As shown in FIG. 8, the illuminating device 10 can further includes the signal device 130 connected to the first electrodes and second electrodes 142, 144. The signal device 130 can include the electrical signal devices, pulsating direct current signal devices, and alternating current devices. The electric signals input from the signal device to the sound wave generator 102 can be amplified alternating electrical current, pulsating direct current signals, or audio electrical signals. Energy of the electric signals is absorbed by the carbon nanotube structure and then radiated as heat. This heating causes detectable sound signals due to pressure variation in the surrounding (environmental) medium. In one embodiment, the signal device 130 can include a mp3 player and a amplifier connected to the mp3 player. The amplifier power amplifies audio electric signals output from the mp3 player and input the power amplified electric signals into the sound wave generator 102.

Figure 9:
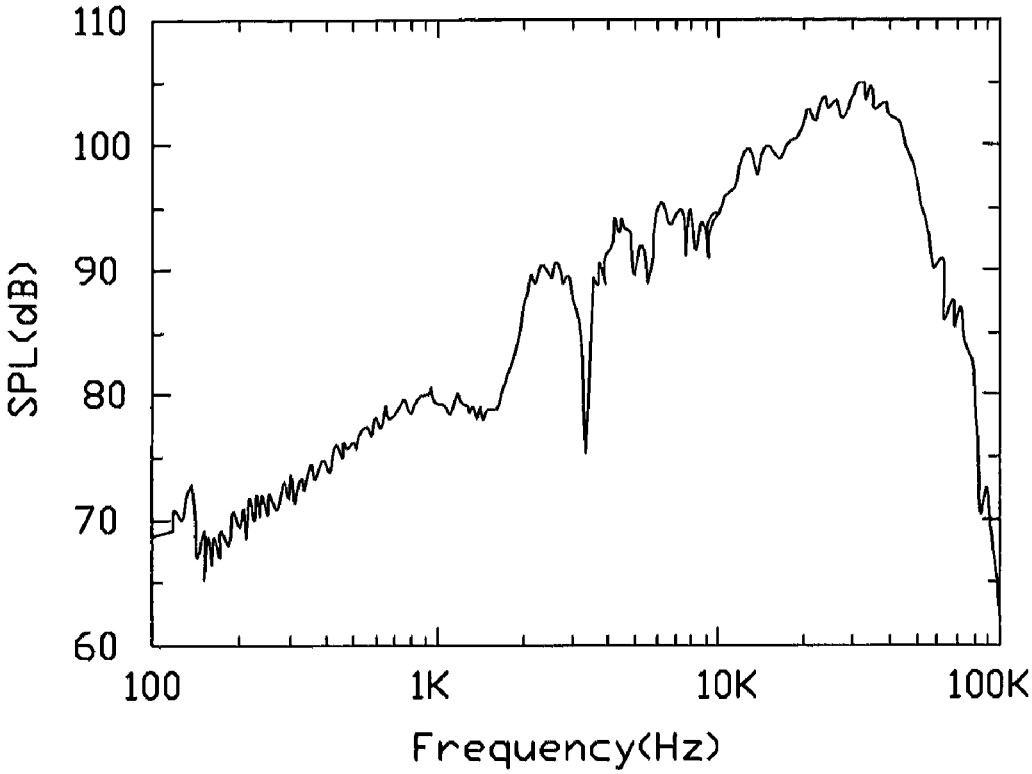
FIG. 9 is a frequency response curve of a sound wave generator according to one embodiment.

FIG. 9 shows a frequency response curve of an acoustic member like the acoustic member 100 according to the embodiment described in FIG. 1. To obtain these results, an alternating electrical signal with 50 volts is applied to a carbon nanotube film which is drawn from a carbon nanotube array, and having a length and width of 30 millimeters. A microphone disposed at about 5 centimeters away and in front of the sound wave generator 102 is used to measure the performance of the thermoacoustic device 10. As shown in FIG. 9, the tested acoustic member, has a wide frequency response range and a high sound pressure level. The sound pressure level of the sound waves generated by the acoustic member 100 can be greater than 50 dB. The sound pressure level generated by the acoustic member 100 reaches up to 105 dB. The frequency response range of the acoustic member 100 can be from about 1 Hz to about 100 KHz with power input of 4.5 W.

In one embodiment, the carbon nanotube structure of the acoustic member 100 includes five parallel carbon nanotube wire structures, a distance between adjacent two carbon nanotube wire structures is 1 centimeter, and a diameter of the carbon nanotube wire structures is 50 micrometers, when an alternating electrical signals with 50 volts is applied to the carbon nanotube structure, the sound pressure level of the sound waves generated by the acoustic member 100 can be greater than about 50 dB, and less than about 95 dB. The sound wave pressure generated by the acoustic member 100 reaches up to 100 dB. The frequency response range of one embodiment illuminating device 10 can be from about 100 Hz to about 100 KHz with power input of 4.5 W.

It is to be understood that the light source 110 and the acoustic member 100 can be separately connected to different circuits. In another embodiment, the light source 110 and the acoustic member 100 can be connected to an integrated circuit to modulate the brightness or color of the light source 110 according to volume changes of the sound emitted from the sound wave generator 102. More specifically, the integrated circuit can be capable of controlling the brightness of the light source 110 by using a capacitor and a resistor according to the voltages of the input signals. When the illuminating device 20 includes more than one light source 110, the integrated circuit can be designed to control the brightness of the light sources 110 according to the frequencies of the input signals. Thus, when different tones of sounds are produced by an array of acoustic members 100, different light sources 110 are powered. The array would provide a visual equalizer display.

Figure 10:
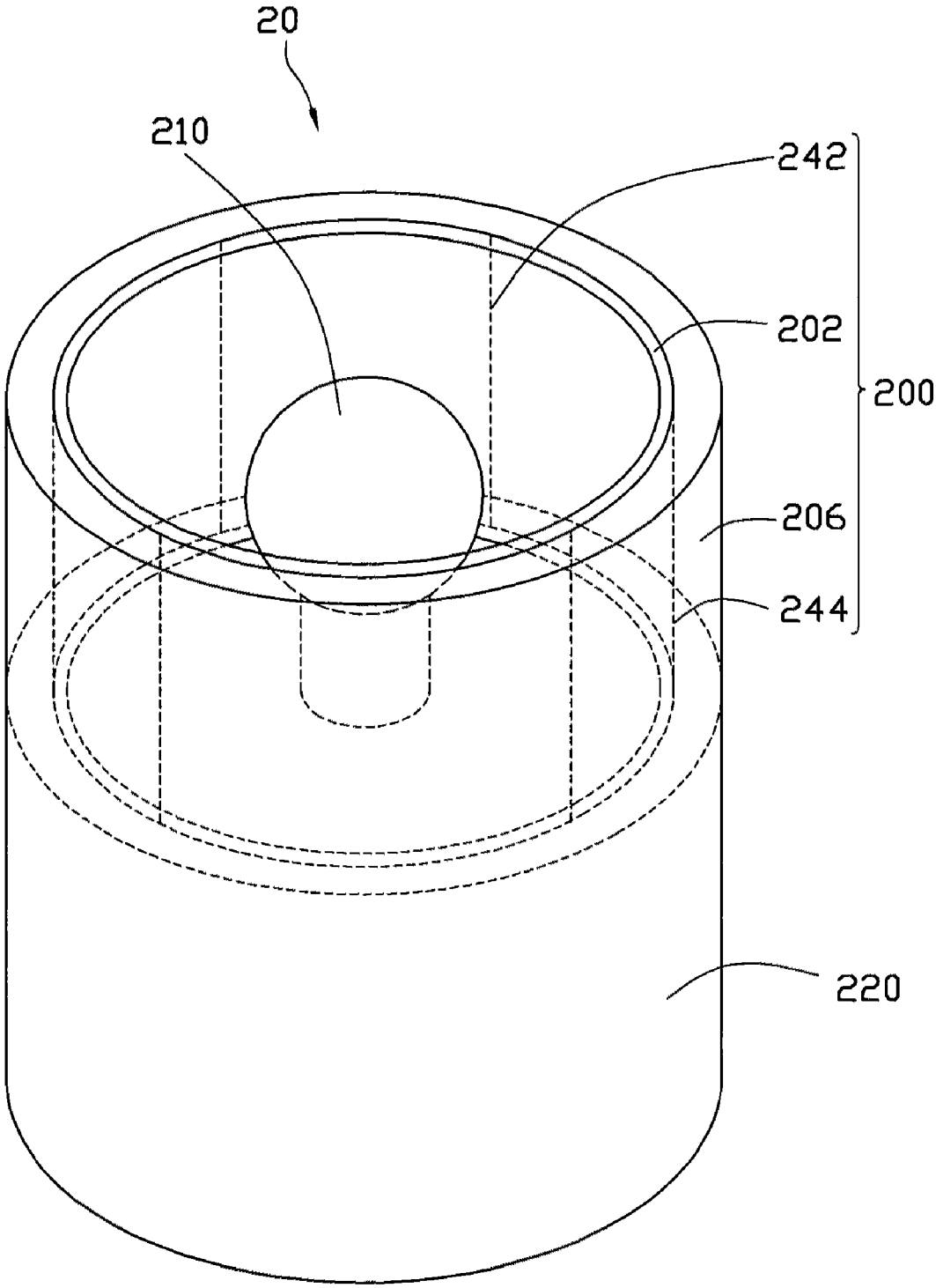
FIG. 10 is a schematic structural view of an illuminating device in accordance with an embodiment.

Referring to the embodiment shown in FIG. 10, an illuminating device 20 includes a light source 210, an acoustic member 200, and a holding element 220. The light source 210 is mounted on the holding element 220. The acoustic member 200 is held by the holding element 220 and adjacent to the light source 210. The acoustic member 200 includes a sound wave generator 202, at least one first electrode 242, and at least one second electrode 244. The sound wave generator 202 includes a carbon nanotube structure. The first electrode and second electrode 242, 244 are spaced from each other. If there are more than two total electrodes, the first and the second electrodes 242, 244 are alternatively connected to the carbon nanotube structure.

The acoustic member 200 further includes a supporting element 206 to support the sound wave generator 202 and first and second electrodes 242, 244. The supporting element 206 is disposed on and/or in the holding element 220. The first and second electrodes 242, 244 are located on and/or in the supporting element 206.

The shape of the supporting element 206 is not limited, nor is the shape of the sound wave generator 202. The supporting element 206 can be flat, curved, or be three dimensional structure with a hollow space therein. In one embodiment, the supporting element 206 has a curved surface and at least partially surrounds the light source 210. In other embodiments, the supporting element 206 has a three dimensional structure with a hollow space therein, and at least partially enclose the light source 210. In other embodiments, the supporting element 206 is planar, and is disposed at one side of the light source 210 and faces the light source 210. When the supporting element 206 encloses or partially encloses the light source 210, the supporting element 206 with the acoustic member 200 thereon can be used as a lampshade.

The material of the supporting element 206 is not limited, and can be a rigid material, such as diamond, glass or quartz, or a flexible material, such as plastic, resin or fabric. The supporting element 206 should have a suitable toughness and strength to support the sound wave generator 202 and first and second electrodes 242, 244. The supporting element 206 can have a good thermal insulating property, thereby preventing the supporting element 206 from absorbing the heat generated by the sound wave generator 202. In addition, the supporting element 206 can have a relatively rough surface, thereby the sound wave generator 202 can have an increased contact area with the surrounding medium. The supporting element 206 can be transparent or have an acceptable light transmittance. In one embodiment, the supporting element 206 can be a lampshade.

Since the carbon nanotubes structure has a large specific surface area, the sound wave generator 202 can be adhered directly on the supporting element 206 without the use of adhesives. However adhesives can be used.

The sound wave generator 202 is supported by the supporting element 206, and thus the first and second electrodes 242, 244 need only provide conductive functions and not support the generator 202. For example, the first and second electrodes 242, 244 can be made of silver paste formed on and/or in the supporting element 206.

The supporting element 206 can be a transparent tubular structure. The material of the supporting element 206 can be glass. The light source 210 is disposed at a center of the tubular structure, and mounted on the holding element 220 together with the supporting element 206. The sound wave generator 202 can be disposed on the inner surface of the tubular structure, and the supporting element 206 can protect the sound wave generator 202. The first and second electrodes 242, 244 are conductive lines formed on the inner surface of the tubular structure, and the sound wave generator 202 covers the first and second electrodes 242, 244 thereby connecting to the first and second electrodes 242, 244. The number of each of the first and second electrodes 242, 244 can be three as shown in the embodiment shown in FIG. 10. The first and second electrodes 242, 244, are spaced and alternatively formed on the inner surface of the supporting element 206.

In another embodiment, the sound wave generator 202 can be disposed on the outer surface of the tubular structure, and a protecting layer can be located on the sound wave generator 202 to protect the sound wave generator 202.

Figure 11:
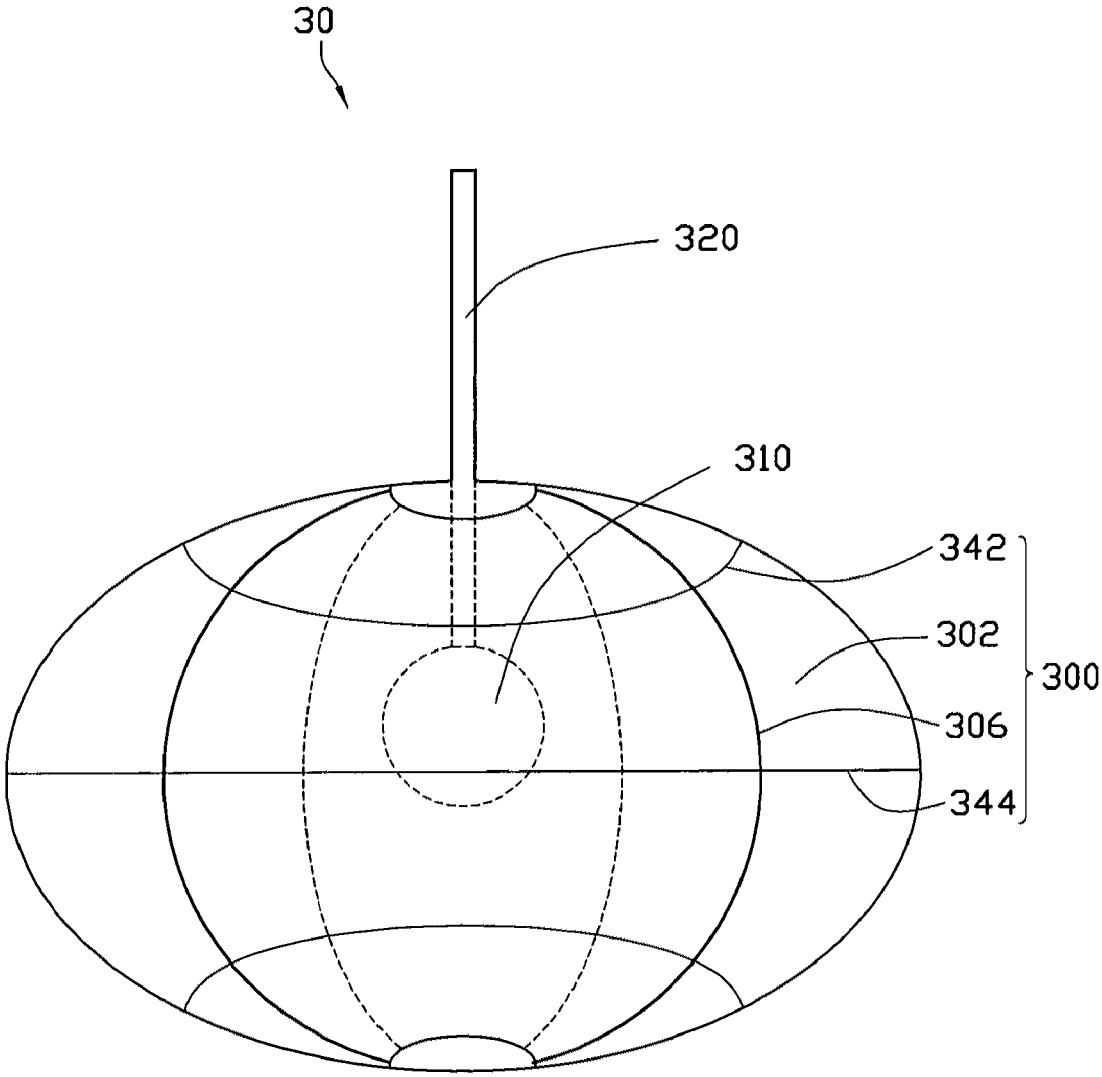
FIG. 11 is a schematic structural view of an illuminating device in accordance with an embodiment.

Referring to FIG. 11, an illuminating device 30, according to another embodiment, includes a light source 310, an acoustic member 300, and a holding element 320. The light source 310 is mounted on the holding element 320. The acoustic member 300 is held by the holding element 320 and adjacent to the light source 310. The acoustic member 300 includes a sound wave generator 302, at least one first electrode 342, and at least one second electrode 344. The sound wave generator 302 includes a carbon nanotube structure. The first electrode and second electrode 342, 344 are spaced from each other and connected to the carbon nanotube structure.

The acoustic member 300 further includes a framing element 306 to support the sound wave generator 302. The framing element 306 is held by the holding element 320. A portion of the sound wave generator 302 is located on a surface of the framing element 306, and other parts of the sound wave generator 302 are suspended. The suspended part of the sound wave generator 302 has a larger area in contact with the surrounding medium. A material of the framing element 306 can be selected from suitable materials including wood, plastics, and resins. The framing element 306 can be insulated from the sound wave generator 302. Further, the holding element 320 can be a hanging member that can be mounted on a ceiling. The light source 310 and acoustic member 300 are hanged in air by the hanging member.

As shown in FIG. 11, the framing element 306 can include a plurality of curved rods. The curved rods are aligned along the longitudinal direction of the framing element 306. The first and second electrodes 342, 344 are aligned along a latitudinal direction of the framing element 306. The rods crossed and can be fixed to the first and second electrodes 342, 344. The framing element 306 together with the first and second electrodes 342, 344 form a cage-like structure. The cage-like structure encloses the light source 310. The sound wave generator 302 is located on the exterior or interior of the cage-like structure and surrounds the light source 310. In one embodiment, the sound wave generator 302 includes a plurality of strip-shaped carbon nanotube films. The strip-shaped carbon nanotube films are located on the cage-like structure side by side and aligned along the longitudinal direction of the framing element 306. The carbon nanotubes in the carbon nanotube films are aligned along the longitudinal direction of the framing element 306.

In the embodiment shown in FIG. 11, the acoustic member 300 includes annular first electrodes 342 and annular second electrodes 344, the rods in the framing element 306 are curved and form a round cage together with the annular first and second electrodes 342, 344. The cage is used as the lampshade of the illuminating device 30.

It is to be understood that, the first and second electrodes 342, 344 can also be conductive rods aligned along the longitudinal direction, and the rods in the framing element 306 can be aligned along the latitudinal direction. The carbon nanotubes in the carbon nanotube structure can be aligned along the latitudinal direction.

Figure 12:
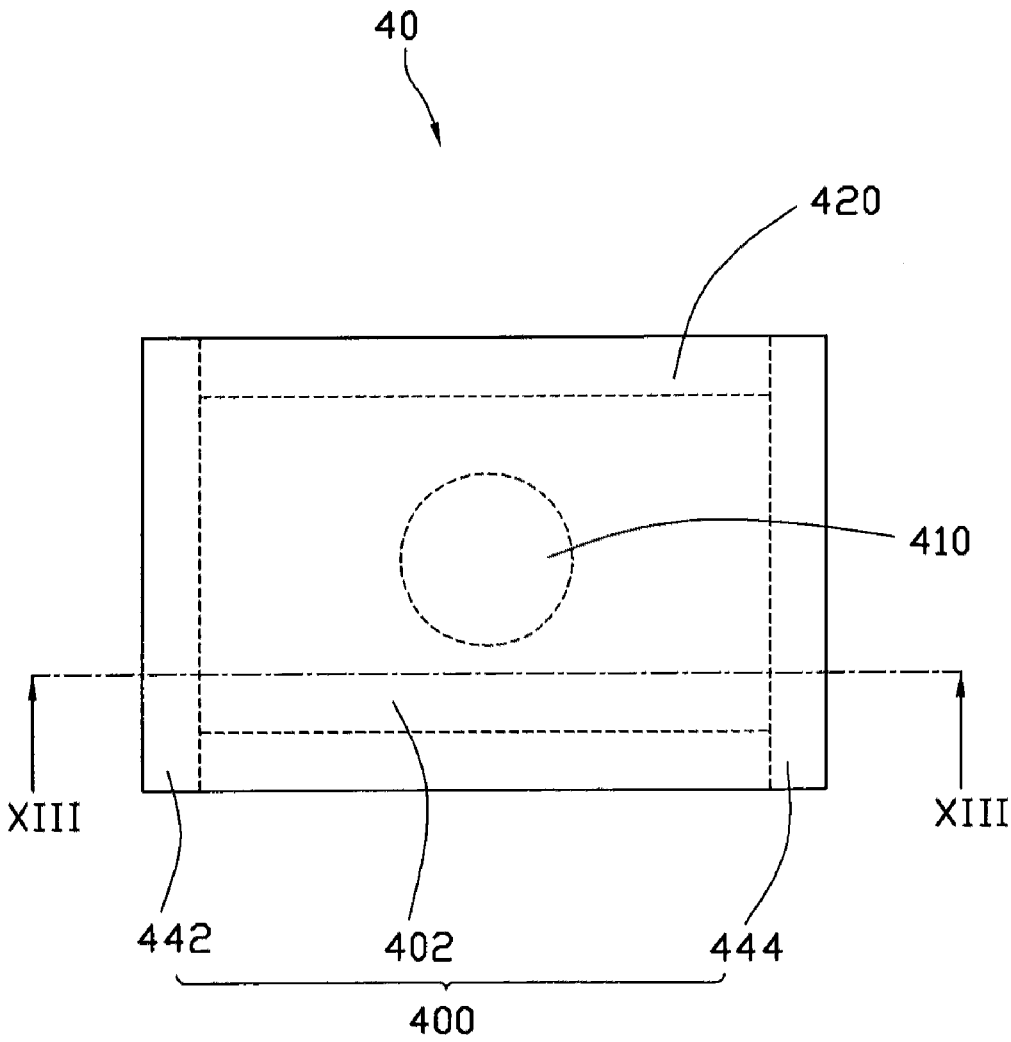
FIG. 12 is a schematic top view of an illuminating device in accordance with an embodiment.
Figure 13:
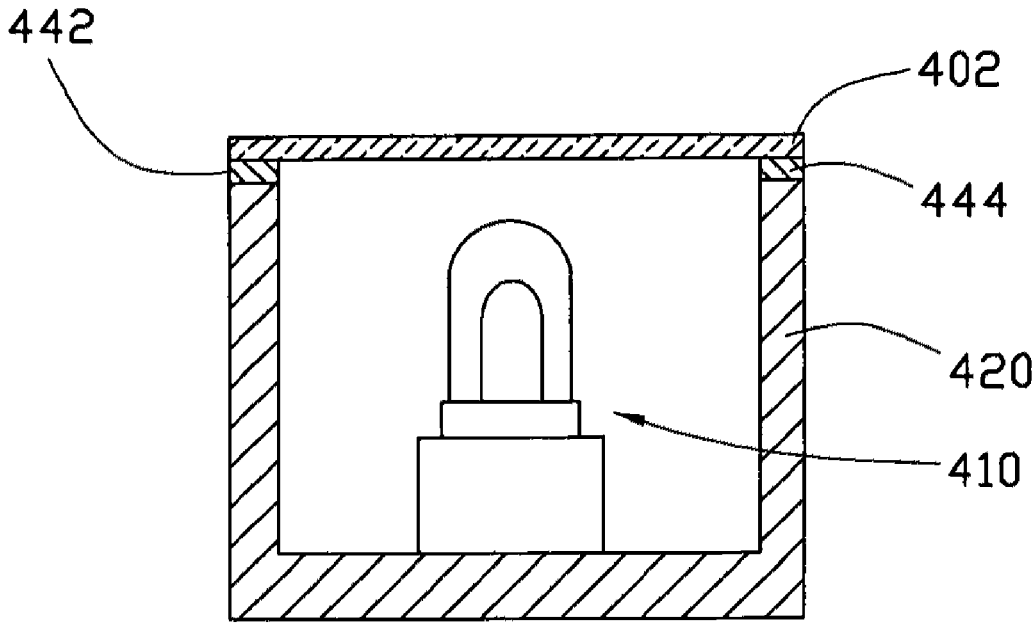
FIG. 13 is a cross-sectional view of the illuminating device of FIG. 12 along the line I-I'.

Referring to FIG. 12, an illuminating device 40, according to another embodiment, includes a light source 410, an acoustic member 400, and a holding element 420. The light source 410 is mounted on the holding element 420. The acoustic member 400 is held by the holding element 420 and adjacent to the light source 410. The acoustic member 400 includes a sound wave generator 402, at least one first electrode 442, and at least one second electrode 444. The sound wave generator 402 includes a carbon nanotube structure. The first electrode and second electrode 442, 444 are spaced apart from each other and connected to the carbon nanotube structure.

The holding element 420 can define a hollow space therein and an opening connected to the hollow space. The light source 410 can be disposed in the hollow space and mounted on the inner wall or bottom of the holding element 420. The sound wave generator 402 can be located on the holding element 420 and cover the opening. Therefore, the holding element 420 can be used as a framing element to support a portion of the sound wave generator 402, and suspend the other portion of the sound wave generator 402.

The sound wave generator 402 is supported by the holding element 420, and thus the first and second electrodes 442, 444 need only provide conductive functions and not support the generator 402. For example, the first and second electrodes 442, 444 can be made of silver paste formed on and/or in the supporting element 406. In the shown embodiment, the acoustic member 400 only includes one first electrode 442 and one second electrode 444. The first and second electrodes 442, 444 are made of silver paste that covered on opposite sides of the opening.

In other embodiment, the first and second electrodes 442, 444 can be metal wires that disposed on the opening and spanned from one side to the other side, and parallel to each other. The sound wave generator 402 can be supported by the first and second electrodes 442, 444. Additionally, the first and second electrodes 442, 444 can serve as support for the sound wave generator 402 in other embodiments.

It is to be understood that the shapes of the illuminating device as well as the acoustic member therein can be varied according to actual needs. For example, the sound wave generator does not have to cover all the surface of the supporting element. The sound wave generator can supported by the electrodes, supporting element, and/or framing element to form different 3-D structures that may have decorative, light, and/or acoustic effects. In one embodiment, the sound wave generator can be attached to a surface of a bulb used as the light source.

It is to be understood that according to different input electric signals, the acoustic member can emit music or noise. The frequency response range of the acoustic member can be from about 1 Hz to about 100 KHz, and thus, the acoustic member can emit an ultrasonic wave. Thus, the illuminating device has an insect and/or pest repellent effect.

The sound wave generator in the acoustic member of the illuminating device need only include a carbon nanotube structure and at least two spaced electrodes connected to the carbon nanotube structure. Thus, the structure of the illuminating device is simple, flexible and has a low cost. The carbon nanotube structure transforms the electric energy to heat that causes surrounding air expansion and contraction according to the same frequency of the input signal and results a hearable sound pressure. Thus, the sound wave generator in the acoustic member can work without vibration and magnetic field. Because there is no need for vibration, the sound wave generator can move and/or flex with none if little impact on the sound produced. The carbon nanotube structure can provide a wide frequency response range (1 Hz to 100 kHz), and a high sound pressure level. The carbon nanotube structure can be cut into any desirable shape and size that meets different needs of different kinds of illuminating device. The carbon nanotube structure can be small in scale, and thus the size of the illuminating device can be decreased. Further, the carbon nanotube structure has a light weight, and the illuminating device adopts the carbon nanotube structure can work without many additional elements in the conventional illuminating device. Thus, the illuminating device can be light weight.

Finally, it is to be understood that the above-described embodiments are intended to illustrate rather than limit the invention. Variations may be made to the embodiments without departing from the spirit of the invention as claimed. Elements associated with any of the above embodiments are envisioned to be associated with any other embodiments. The above-described embodiments illustrate the scope of the invention but do not restrict the scope of the invention.

What is claimed is:

1. An illuminating device comprising:

a light source; and an acoustic member that comprises a carbon nanotube structure;

wherein the carbon nanotube structure produces sound in response to an electrical signal that is capable of causing the carbon nanotube structure to increase in temperature; and the carbon nanotube structure is in contact with a medium and is capable of transmitting heat to the medium.

2. The illuminating device of claim 1, wherein the acoustic member at least partially surrounds the light source.

3. The illuminating device of claim 1, wherein the acoustic member encloses or partially encloses the light source.

4. The illuminating device of claim 1, wherein the acoustic member is disposed at a side of the light source.

5. The illuminating device of claim 1, wherein the heat capacity per unit area of the carbon nanotube structure is less than or equal to $2\times10^{-4}$ J/cm$^2$·K.

6. The illuminating device of claim 1, wherein a light transmittance of the carbon nanotube structure is above 80%.

7. The illuminating device of claim 1, wherein the frequency response range of the acoustic member ranges from about 1 Hz to about 100 KHz.

8. The apparatus of claim 1, wherein the carbon nanotube structure has a substantially planar structure, and a thickness of the carbon nanotube structure is in the range of about 0.5 nanometers to about 1 millimeter.

9. The apparatus of claim 1, wherein the carbon nanotube structure comprises a plurality of carbon nanotubes, and the carbon nanotubes are combined by van der Waals attractive force therebetween.

10. The apparatus of claim 9, wherein the carbon nanotubes are arranged in a substantially systematic manner.

11. The apparatus of claim 9, wherein the carbon nanotubes are arranged along many different directions, such that the number of carbon nanotubes arranged along each different direction is almost the same.

12. The apparatus of claim 9, wherein the carbon nanotubes are aligned substantially along a same direction.

13. The apparatus of claim 9, wherein the carbon nanotubes are joined end to end by van der Waals attractive force therebetween.

14. The apparatus of claim 1, wherein the carbon nanotube structure comprises at least one carbon nanotube film, at least one carbon nanotube wire, or a combination of at least one carbon nanotube film and at least one carbon nanotube wire.

15. The apparatus of claim 1, wherein the acoustic member comprises at least two electrodes, the at least two electrodes are electrically connected to the carbon nanotube structure.

16. The apparatus of claim 15, wherein the carbon nanotube structure comprises a plurality of carbon nanotubes, the carbon nanotubes in the carbon nanotube structure are aligned along a direction from one electrode to another electrode.

17. The apparatus of claim 1, further comprising a holding element holding the light source and the acoustic member, wherein the acoustic member comprises a supporting element held by the holding element, the carbon nanotube structure is disposed on the supporting element.

18. The apparatus of claim 1, further comprising a holding element holding the light source and the acoustic member, wherein the acoustic member comprises a framing element held by the holding element, the carbon nanotube structure is supported by the framing element.

19. An acoustic illuminating device comprising:

a support;

a light source fixed to the support;

at least one first electrode and at least one second electrode connected to the support; and a sound wave generator surrounding the light source, wherein the sound wave generator comprises of at least one carbon nanotube structure, the at least one carbon nanotube structure is attached to the first and second electrodes, and the carbon nanotube structure is capable of converting electrical signals into heat and transferring the heat to a medium to cause a thermoacoustic effect.

20. An illuminating device comprising:

a light source; and an acoustic member that comprises a carbon nanotube structure, wherein the heat capacity per unit area of the carbon nanotube structure is less than or equal to $2\times10^{-4}$ J/cm$^2$·K.

* * * * *